US005259578A

United States Patent [19]

Jones et al.

[11] Patent Number: 5,259,578

[45] Date of Patent: Nov. 9, 1993

[54] TIRE DISPLAY ASSEMBLY

[75] Inventors: Thomas R. Jones, Newton; Arthur G. Shields, Lincolnton, both of N.C.

[73] Assignee: The J. H. Heafner Company, Lincolnton, N.C.

[21] Appl. No.: 945,395

[22] Filed: Sep. 16, 1992

[51] Int. Cl.[5] ..... A45D 19/04

[52] U.S. Cl. ..... 248/174; 211/24; 297/440.13

[58] Field of Search ..... 248/150, 174, 459; 297/442; 40/539, 587; 211/23, 24, 70.1; D6/310, 460

[56] References Cited

U.S. PATENT DOCUMENTS

| | | | |
|---|---|---|---|
| 3,139,255 | 6/1964 | Palm | 248/150 |
| 3,717,377 | 2/1973 | Johnson | 297/442 X |
| 3,836,104 | 9/1974 | Miller et al. | 248/150 |
| 3,999,662 | 12/1976 | Barnhardt | 248/174 X |
| 4,384,651 | 5/1983 | Smith | 248/150 X |
| 4,773,622 | 9/1988 | Herlin | 248/152 X |
| 4,875,737 | 10/1989 | Cardenas | 297/442 |

*Primary Examiner*—Ramon O. Ramirez
*Attorney, Agent, or Firm*—Olive & Olive

[57] ABSTRACT

A tire display assembly comprising folding blanks which, when assembled, simulates a car seat and is capable of supporting and displaying a vehicle tire. When the assembly is used to display a tire the tire rests on the part of the display which simulates the cushion of a car seat and leans against the part which simulates a backrest of a car seat. A mass support is inserted in the space defined by the parts of the assembly which simulates the cushion of a car seat and is designed to carry the mass of the tire and add rigidity to the tire display assembly. A header upon which printed matter can be posted is situated on top of the part of the assembly which simulates a backrest of a car seat.

9 Claims, 5 Drawing Sheets

TIRE DISPLAY ASSEMBLY

BACKGROUND OF THE INVENTION

1. Field of the Invention

This invention relates to folding blank displays and, more particularly, to a folding blank display which simulates a car seat and is capable of supporting and displaying a vehicle tire.

2. Description of Related Art

Few display assemblies which are capable of displaying a vehicle tire are available. Tire display stands may be made of metal, for example see U.S. Pat. No. 4,573,587, however these stands are typically heavy and expensive to manufacture. Other display assemblies, such as found in U.S. Pat. No. 4,856,659, do not provide means for posting technical data about the tire or advertising and promotional materials.

The tire display assembly of the invention is light in weight, foldable, easy and inexpensive to manufacture. The tire display assembly permits tire merchants to display tires in an attractive manner which blends into the decor of a tire showroom and allows display of technical information and advertising and promotional printed matter.

It is an advantage of the invention that the tire display assembly is foldable.

Another advantage of the invention is that the tire display assembly simulates a car seat in appearance.

It is a further advantage of the invention that the tire display assembly permits the posting of printed matter.

Yet another advantage of the invention is that the tire display assembly is capable of supporting tires of various sizes.

Other objects and advantages will be more fully apparent from the following disclosure and appended claims.

SUMMARY OF THE INVENTION

The tire display assembly of this invention is constructed preferably of nine folding blanks which are folded and adhesively connected to form the tire display assembly. In the preferred embodiment the folding blanks are made of double-sided corrugated plastic, however, other materials such as corrugated cardboard or the like are suitable materials.

Three folding blanks of the invention, generally comprising a base, a vertical support and a front blank, are folded and preferably adhesively connected to form the seat assembly, which is in the general shape of a car seat. In the preferred embodiment the seat assembly is in the shape of a car seat of the "bucket-seat" type, however, as different car seats differ in size and shape, the tire display assembly may also be varied to meet particular display and design needs or particular aesthetical considerations. For example, other tire display assembly may be designed to simulate a "bench" or a "split" type car seat.

The front, base and vertical support blanks of the invention are sized and proportioned so that the tire display assembly which is formed from these blanks, once completed, is capable of supporting a land-vehicle tire, said tire resting upon the part of the tire display assembly that resembles a cushion of a car seat and leans against the part of the tire display assembly that resembles a backrest of a car seat. To provide additional rigidity to the tire display assembly the preferred embodiment utilizes an optional mass support.

Four other blanks of this invention, generally comprising two identical tapered support blanks and two rectangular support blanks, are attached perpendicular to each other to form a mass support. The mass support blanks of the invention are sized and proportioned to generally fit inside the space defined by the folded blanks which comprise the seat assembly and, more particularly, the space defined by the part which resembles a cushion of a car seat.

Two other panels of this invention are folded and preferably adhesively connected to form a header. The header of the invention is designed to fit on the top panel, which is a part of the front blank, much in the same position as a headrest would be positioned on a car seat. The header of the invention is designed so that information relating to the merchandise can be textually represented or posted on the header panel.

Other aspects and features of the invention will be more fully apparent from the following disclosure and appended claims.

DETAILED DESCRIPTION OF THE INVENTION AND PREFERRED EMBODIMENTS THEREOF

Figure 1:
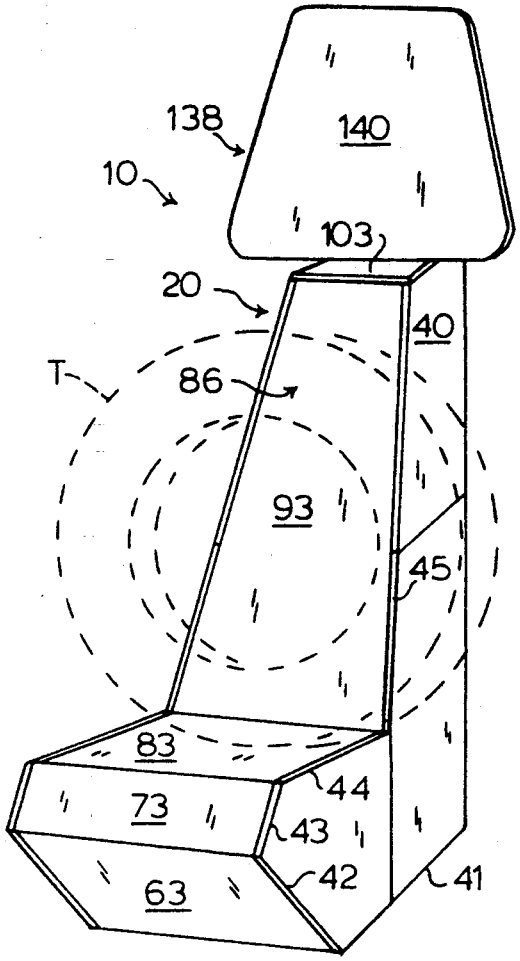
FIG. 1 is a perspective view of the blanks of the invention shown folded and connected to form the tire display assembly in a fully assembled condition.
Figure 2:
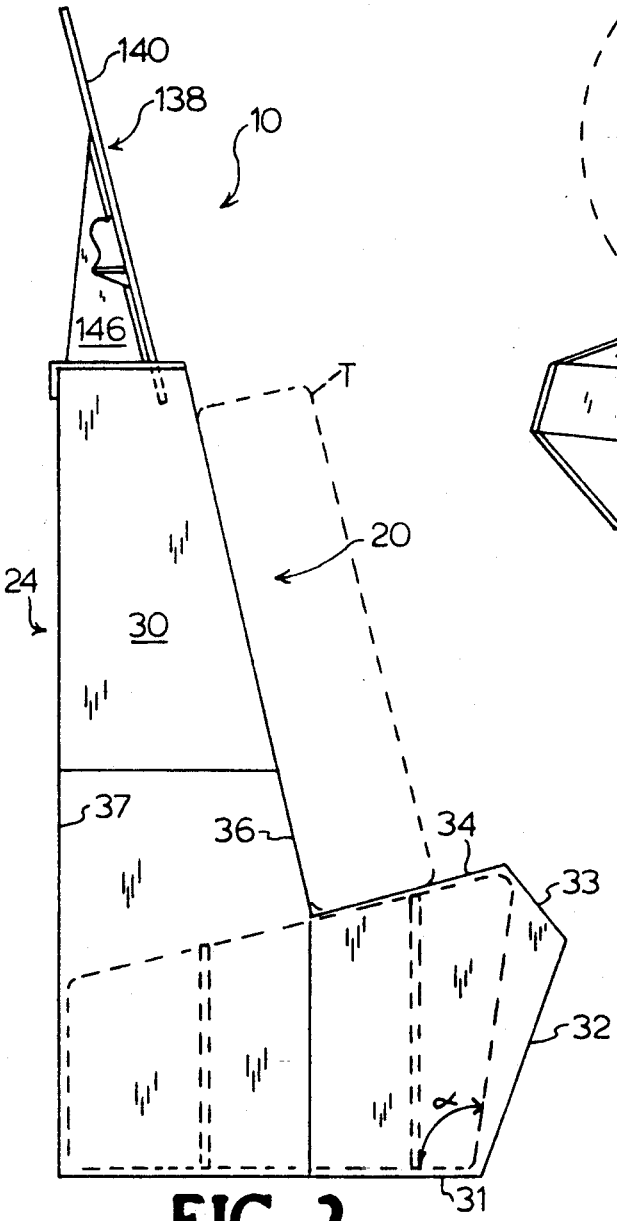
FIG. 2 is a side view of the blanks of the invention shown folded and connected to form the tire display assembly in a fully assembled condition and with a representative tire shown in dashed lines.

In general, erected tire display assembly 10 of the invention, shown in FIGS. 1 and 2, is comprised preferably of nine folding blanks cut by conventional techniques from a suitable material which is capable of being folded such as, for example, cardboard, corrugated cardboard, corrugated plastic, plastic coated cardboard or the like. The folding blanks of the invention are folded along score lines which may be made by conventional techniques developed for scoring the material chosen for the blanks. As the folding blanks of the preferred embodiment are made of a double sided corrugated plastic, a score line constitutes a cut on the side of the double sided corrugated plastic. The score line by its location and depth defines the extent of the angle of fold along the score line. The score line is preferably made on the side of each respective panel which defines the angle of fold.

The blanks of the invention may be secured together to form the tire display assembly of the invention by any conventional securing means known in the art, such as adhesive, hot melt or staples. As used herein the word "adhesive" and variations thereof includes any of the means of fastening known in the art which might be used to secure the blanks together. In the preferred embodiment the folding blanks are secured together by providing the blanks with flaps which are held in place by double sided adhesive tapes. Although in the description particular panels are described as having flap portions, it is to be understood that when two panels are to be attached to each other, the flap portion may be an extension of either panel and, therefore, many variations which are equivalent to each other are available for the arrangement of the flap portions. In the description, the term "concealed" surface refers to a surface of a blank which is not exposed to the observer once the blank is properly folded.

Figure 3:
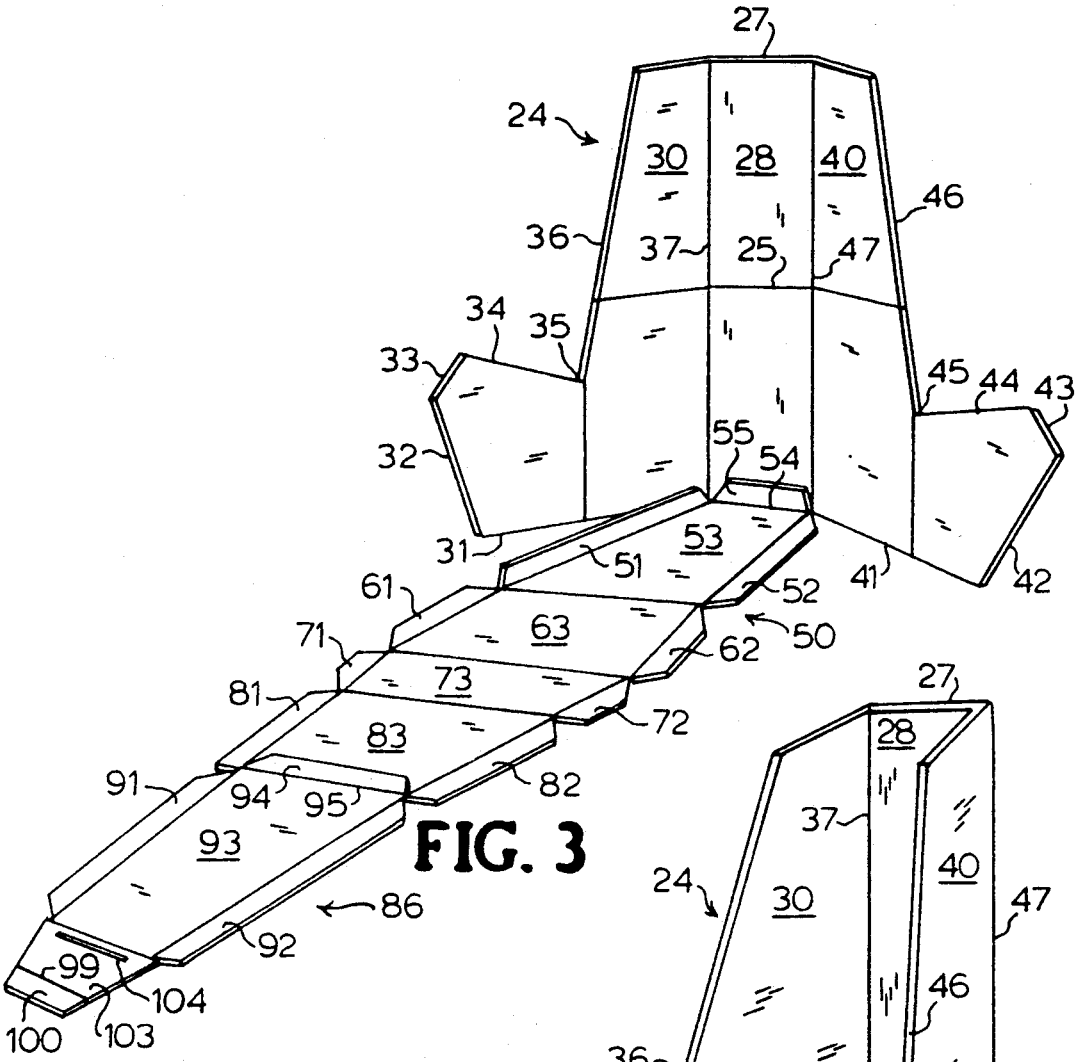
FIG. 3 is a perspective view of the blanks comprising the seat assembly in a partially assembled condition.
Figure 6:
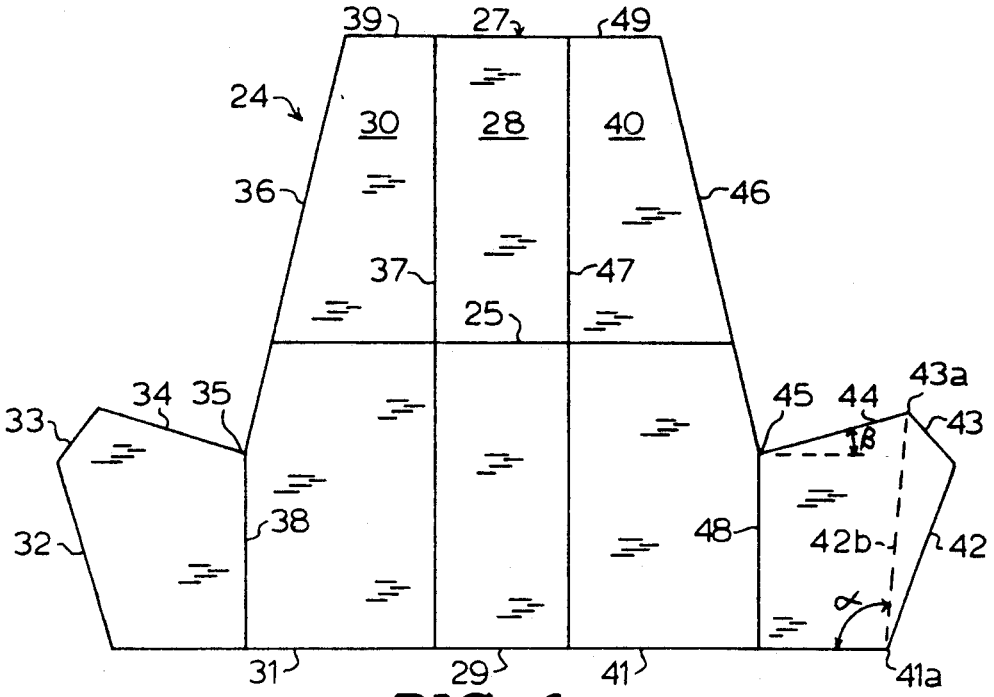
FIG. 6 is a front elevation view of what becomes after assembly the concealed surface of the vertical support folding blank.
Figure 7:
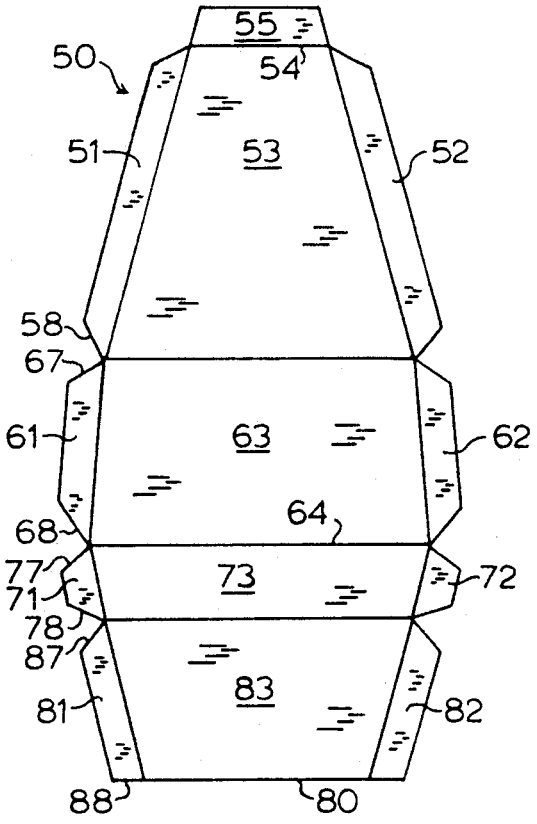
FIG. 7 is a top plan view of what becomes after assembly the concealed surface of the base folding blank.
Figure 8:
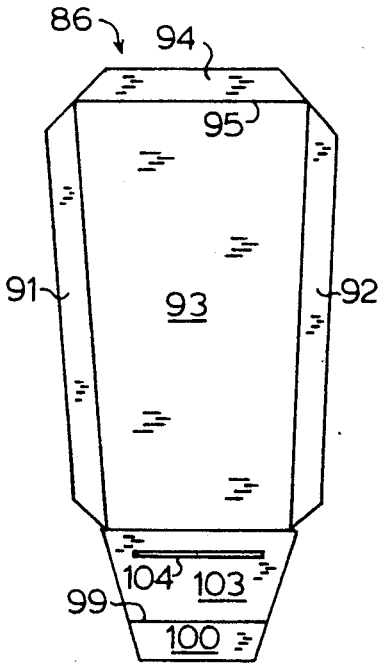
FIG. 8 is a top plan view of what becomes after assembly the concealed surface of the front folding blank.
Figure 9:
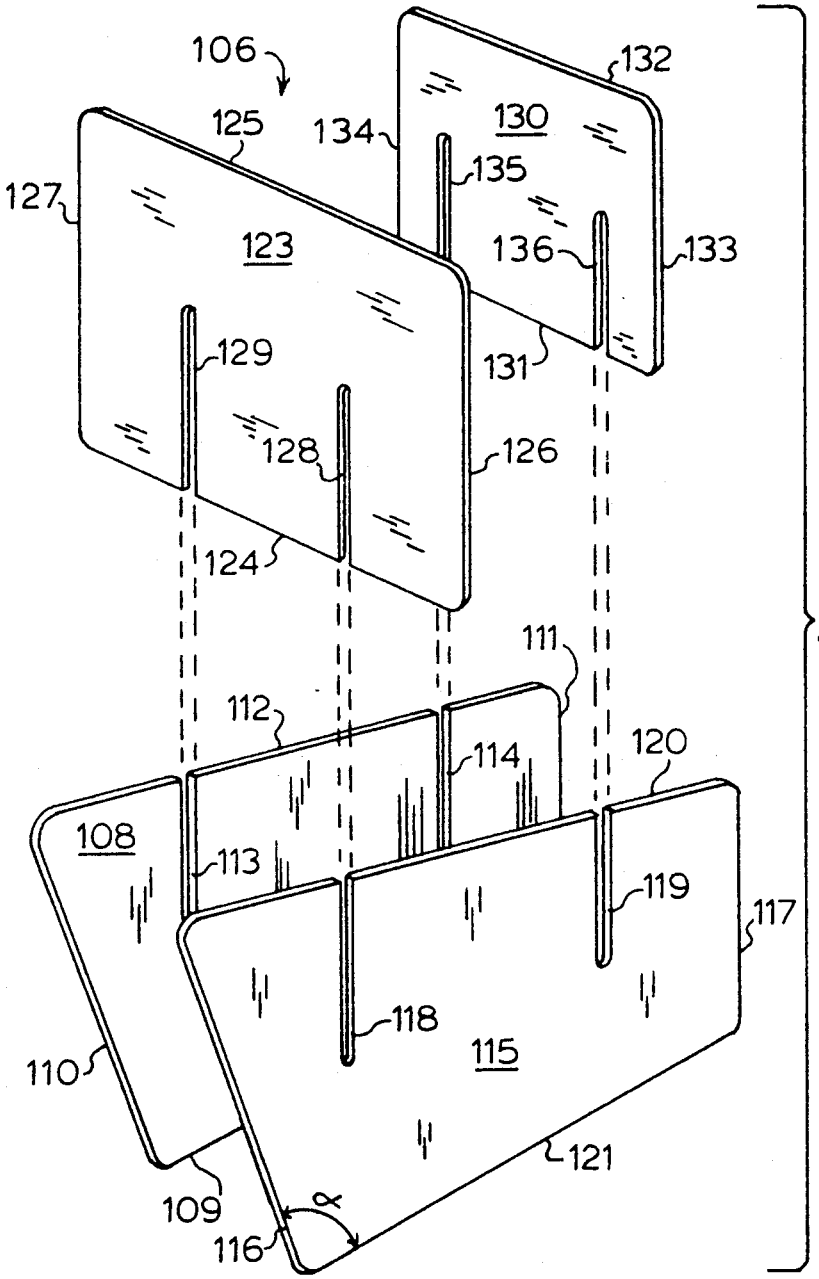
FIG. 9 is an exploded perspective view of the mass support folding blanks of the invention.
Figure 11:
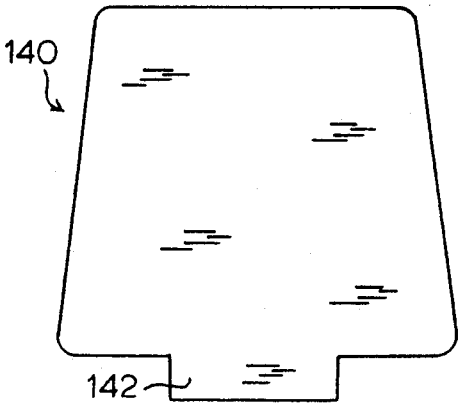
FIG. 11 is a front elevation view of the surface of the header board folding blank.
Figure 10:
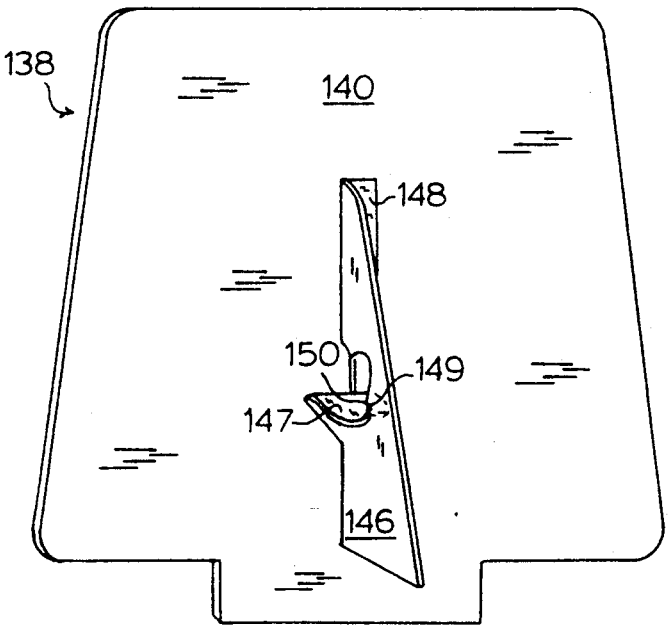
FIG. 10 is a perspective rear view of the header folding blanks of the invention after being folded and adhesively connected in a fully setup condition.
Figure 12:
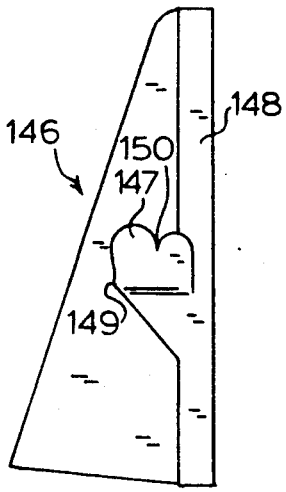
FIG. 12 is a side view of the surface of the easel folding blank.

Referring to the Figures and, particularly to FIGS. 1, 2, and 3, three folding blanks, generally comprising vertical support 24, base folding blank 50 and front folding blank 86, shown separately in FIGS. 6, 7, and 8 respectively, are folded and adhesively connected to form seat assembly 20 shown assembled in FIGS. 1 and 2. Another four blanks of the invention, shown generally in FIG. 9, and comprising first rectangular support 123, second rectangular support 130, first tapered support 108 and second tapered support 115, are perpendicularly connected to each other via slits to form mass support 106 shown assembled in FIG. 4. Another two blanks of the invention, generally comprising header panel 140 and easel 146, as shown generally in FIGS. 10, 11 and 12, are folded and adhesively connected to form header 138 as shown assembled with seat assembly 20 in FIGS. 1 and 2.

Referring to FIGS. 2 and 6, vertical support 24 is formed of a blank generally comprising spine 28, first side panel 30 and second side panel 40. Spine 28 of vertical support 24 is in the general shape of a rectangle, and is defined by floor end 29, top end 27, a first vertical side coinciding with score line 37 and a second vertical side coinciding with score line 47. Side panel 30 of vertical support 24 in its general shape resembles the profile of a car seat, and is also defined by floor end 31, front end 32, knee end 33 and cushion end 34 which together resemble the profile of a car seat cushion, and is further defined by backrest end 36 and top end 39 which together resemble the profile of a car seat backrest. First side panel 30 of vertical support 24 is foldably connected to spine 28 along a vertical end coinciding with first score line 37.

Side panel 40 of vertical support 24 is identical in shape and size to side panel 30 of vertical support 24, and is defined by floor end 41, front end 42, knee end 43 and cushion end 44 which together resemble the profile of a car seat cushion, and is further defined by backrest end 46 and top end 49 which together resemble the profile of a car seat backrest. Second side panel 40 of vertical support 24 is foldably connected to spine 28 along a vertical end coinciding with second score line 47.

Referring to FIG. 7, base folding blank 50 of the invention is generally comprised of floor panel 53, front board 63, knee board 73 and cushion 83. The panels comprising base folding blank 50 are generally in the shape of symmetrical trapezoids of varying heights and widths. Hereinafter, the term "symmetrical trapezoid" refers to a geometrical shape of a trapezoid having a base, two oblique sides which are disposed at each end of the trapezoid base at identical angles, and a side opposite and parallel to the base and which is shorter than the base. The trapezoid height is measured from the base of the trapezoid to the side opposite the base and at a right angle to the base.

Beginning at base flap 55, the width of base folding blank 50 increases, reaches its maximum width at score line 64 between front board 63 and knee board 73, and then decreases in width ending at cushion end 80 at a width about twice the width of base flap 55.

The panels comprising base folding blank 50 are each provided with two side flaps which are foldably connected at each of the two ends that comprise the oblique sides of each of the trapezoids. Floor panel 53 is provided with flaps 51 and 52, front board 63 is provided with flaps 61 and 62, knee board 73 is provided with flaps 71 and 72, and cushion 83 is provided with flaps 81 and 82. Floor panel 53 is also provided with base flap 55 foldably connected to the floor panel 53 at the end comprising the base of the trapezoid.

Referring to FIG. 8, front folding blank 86 of the invention generally comprises backrest 93, top 103 and top flap 100. Backrest 93 is provided with two side flaps 91, 92 and center flap 94. The panels comprising front folding blank 86 are generally in the shape of symmetrical trapezoids of varying heights and widths. Beginning at score line 95, where the width of flap 94 is substantially equal to the width of cushion end 80 of base folding blank 50, the width of front folding blank 86 decreases towards top end 99, where the width is substantially equal to that of base end 54 of base folding blank 50 which itself is substantially equal to the width of spine 28 of vertical support 24.

The combination of panels which constitute base folding blank 50 and front folding blank 86 may be varied to meet particular display and design needs or particular aesthetical considerations. For example, front board 63 and knee board 73 of base folding blank 50 can be replaced by a single panel. Similarly, base folding blank 50 and front folding blank 86 may be made of a single folding blank.

Figure 5:
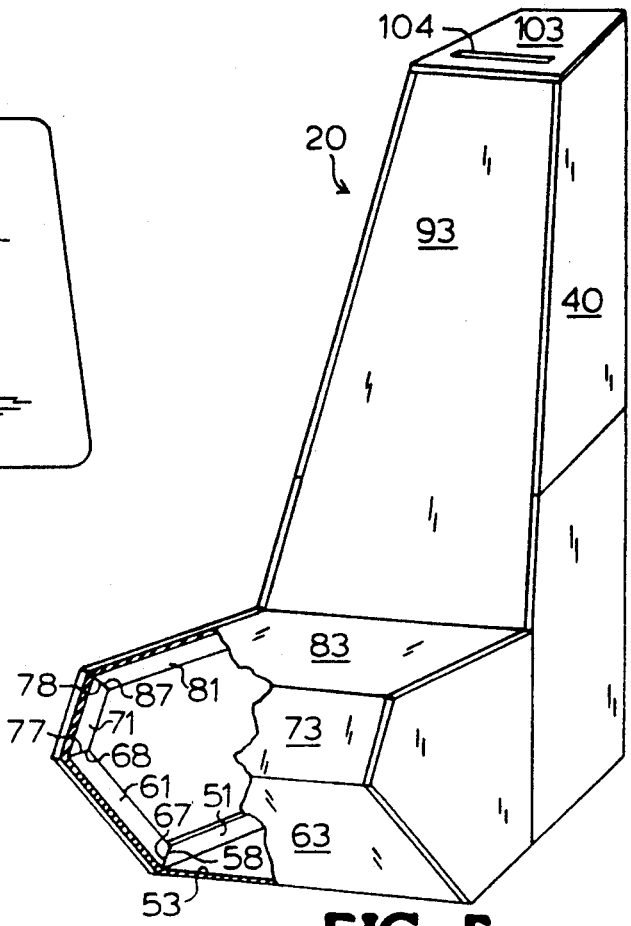
FIG. 5 is a partial cut away view of the assembled seat display assembly. The mass support is omitted.

In FIG. 5 seat display assembly 20 is shown in a partial cutaway view. Mass support assembly 106, shown in FIG. 9, is omitted to better show the details of the flaps as adhered to the blanks. The oblique sides of the flaps of the invention are each cut at a calculated angle so that when the respective panels are folded to their correct respective positions, the oblique side of one flap will touch the oblique side of the other flap. Thus, for example, when floor panel 53, front board 63, knee board 73 and cushion 83 are folded and the respective flaps are adhered into position, oblique side 67 of flap 61 coincides with oblique side 58 of flap 51, oblique side 77 of flap 71 coincides with oblique side 68 of flap 61, and oblique side 87 of flap 81 coincides with oblique side 78 of flap 71.

Referring to FIG. 9, mass support 106 generally comprises two identical tapered supports 108, 115 and two rectangular supports 123, 130. Tapered support 115 is defined by horizontal base 121, first side 116 formed at an angle $\alpha$ at one end of horizontal base 121, second side 117, which is shorter than first side 116, formed at a right angle at an opposite end of horizontal end 121, and upwardly and outwardly sloping slant end 120 disposed opposite to horizontal end 121 and extending from first side 116 to second side 117.

Angle $\alpha$, shown in FIG. 6, is defined by floor end 41 of side panel 40 of vertical support 24 and broken line **42*b* extending from point 41*a* to point 43*a* of side panel 40 of vertical support 24**. The selection of angle $\alpha$ is somewhat arbitrary and was selected in the preferred embodiment to meet aesthetical considerations and the desired objective of simulating a car seat. Although in the preferred embodiment, angle $\alpha$ is slightly larger than a right angle, it can conceivably be varied considerably to meet othrr aesthetical or design requirements.

Sides 110 and 116 of tapered supports 108 and 115 respectively, shown in FIG. 9, are erected at the angle $\alpha$ so that when mass support 106 is properly positioned in tire display assembly 10, cushion 83 is supported by tapered supports 108 and 115 along the entire trapezoid height of cushion 83, as shown in FIGS. 1 and 2.

Two slits 118 and 119 are cut in tapered support 115 extending from slant end 120 towards horizontal end 121 and in a direction perpendicular to horizontal end 121 and terminating about mid-way between horizontal end 121 and end 120. Tapered support 108 is identical in shape and size to tapered support 115 and includes slits 113 and 114 which are identical in shape and size to slits 118 and 119 respectively.

Rectangular support 123 is in a general shape of a rectangle, having lower horizontal end 124, upper horizontal end 125 disposed opposite and parallel to lower horizontal end 124, and first side 126 and second side 127 disposed opposite and parallel to each other. Two slits 128 and 129, identical to each other, are cut in first rectangular support 123 extending perpendicularly from lower horizontal end 124 and terminating about mid-way towards upper horizontal end 125. Second rectangular support 130 is also in a general shape of a rectangle, but smaller in size than rectangular support 123. Rectangular support 130 comprises lower horizontal end 131, upper horizontal end 132 disposed opposite and parallel to lower horizontal support 131, and side 133 and side 134 disposed opposite and parallel to each other. Two slits 135 and 136, preferably identical to each other, extend perpendicularly from lower horizontal end 131 and terminate approximately mid-way towards upper horizontal end 132.

Referring to FIGS. 10, 11, and 12, header 138 comprises header board 140 and easel 146. Header board 140, shown in FIGS. 10 and 11, is in the general shape of a symmetrical trapezoid and includes connector 142 which is generally rectangular in shape. Easel 146, shown in FIGS. 10 and 12, is generally triangular in shape and includes flap 148. Fin 147 is cut in easel 146 in a manner creating notch 149 in easel 146 and indentation 150 in fin 147.

Assembly

Referring to FIG. 3, when tire display assembly 10 is assembled side panel 30 of vertical support 24 is folded along spine score line 37 and side panel 40 is folded along spine score line 47 to a position where the concealed inner surfaces of sides 30 and 40 are facing each other.

Base flap 55 is folded along score line 54 to a position perpendicular to floor panel 53 and is adhesively connected, via the double sided adhesive tape, to spine 28 at spine floor end 29 (as shown in FIG. 3) so that score line 54 is contiguous with floor end 29 of spine 28. Side flap 51 of floor panel 53 is folded to a position perpendicular to floor panel 53 and is adhesively connected to first side panel 30 at floor end 31. Side flap 52 is similarly folded and connected to side panel 40 at floor end 41.

Front board 63 is folded to a position forming the angle $\alpha$ with floor 53, thus having side flaps 61 and 62 coincide with front ends 32 and 42 of vertical support 24 respectively. Side flaps 61 and 62 are then folded and adhesively connected to the concealed surface of side panels 30 and 40 at front ends 32 and 42 respectively.

Figure 4:
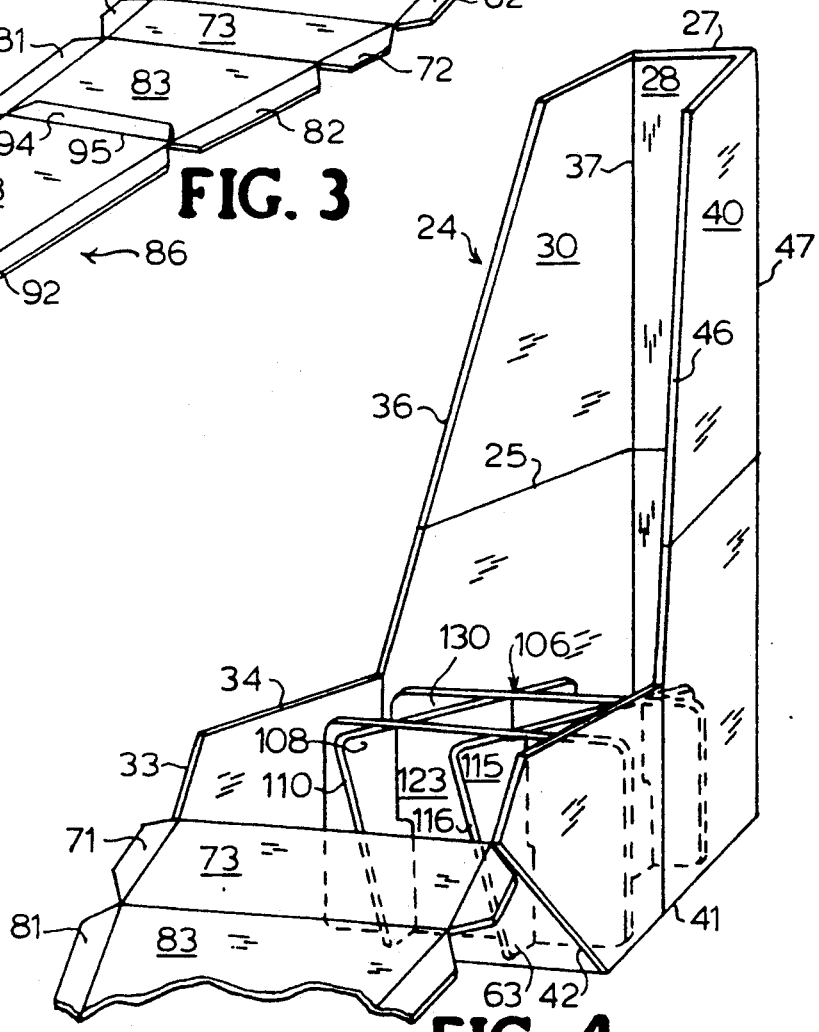
FIG. 4 is a partial cut away perspective view showing the mass support fully assembled and situated in the partially assembled blanks comprising the seat assembly.

If mass support 106 is to be used to provide additional support for the displayed tire, mass support 106 should be assembled before proceeding further on assembly of base folding blank 50. Referring to FIG. 9, mass support 106 is assembled by engaging slit 113 of tapered support 108 with slit 129 of rectangular support 123 so that tapered support 108 and rectangular support 123 are perpendicular to each other. Similarly, slit 114 of tapered support 108 is engaged with slit 135 of rectangular support 130, slit 118 of tapered support 115 is engaged with slit 128 of rectangular support 123, and slit 119 of tapered support 115 is engaged with slit 136 of rectangular support 130. Mass support 106 is then placed in the hollow defined by base folding blank 50 and vertical support 24 and, more particularly the hollow defined by spine 28, first side panel 30, second side panel 40, floor panel 53 and front board 63, as shown in FIG. 4.

When mass support 106 is placed in tire display assembly 10 it is situated so that shorter sides 111 and 117 of tapered supports 108 and 115 respectively are positioned squarely against spine 28 of vertical support 24. The plane occupied by second rectangular support 130 is parallel to the plane occupied by spine 28 and the plane formed by first rectangular support 123 is facing the plane occupied by front board 63 and is parallel to second rectangular support 130. The planes occupied by first tapered support 108 and second tapered support 115 face the planes occupied by side panel 30 and side panel 40 respectively; however, because of the tapered shape of floor panel 53 the planes occupied by first tapered support 108 and second tapered support 115 are purposely not made parallel to the planes occupied by side panel 30 and side panel 40 so as to achieve the desired seat appearance.

Knee board 73 is then folded so that side flaps 71 and 72 are contiguous with and adhesively connect to vertical support 24 at knee ends 33 and 43 respectively. Similarly, cushion 83 is folded so that side flaps 81 and 82 are contiguous with and adhesively connected to cushion ends 34 and 44 respectively, thus having cushion panel 83 resting on mass support 106 and making an angle B with the horizontal (FIG. 6).

Center flap 94 of front folding blank 86 is folded along score line 95 and adhesively connected to base folding blank 50 so that score line 95 is contiguous with cushion end 80. Backrest 93 is then folded so that side flaps 91 and 92 are contiguous with and adhesively connected to sides 30 and 40 at backrest ends 36 and 46 respectively. Top 103 is folded so that score line 99 is contiguous with spine top end 27 and top flap 100 is folded along score line 99 and is adhesively connected to the exposed surface of spine 28. Flap 100 is adhered to the exposed instead of the unexposed surface of spine 28 which enables spine 28 to provide additional support and prevent top 103 from collapsing under the added weight of header 138.

Referring to FIGS. 10, 11, and 12, easel flap 148 of easel 146 is folded to a position perpendicular to easel 146 and is secured in that position by folding fin 147 so that indentation 150 fits into notch 149. Flap 148 is adhesively connected to the rear surface of header panel 140. Connector 142 is then inserted into slit 104 on top 103 of front folding blank 86 as shown in FIGS. 1 and 2.

Referring to FIGS. 1 and 2, when on display, a tire T, shown in dashed lines, is placed on cushion 83 and leans against backrest 93. Cushion 83 was designed to, when assembled, make an angle $\beta$ with the horizontal so that it forces a tire placed on it to lean against backrest 93, thereby preventing the displayed tire from rolling off tire display assembly 10. As shown in FIG. 6, angle $\beta$ is the angle that cushion end 44 makes with floor end 41. Since floor end 41 is horizontal, angle $\beta$ is also defined as the angle cushion end 44 makes with the horizontal.

For shipment purposes the upper half of vertical support 24 is preferably folded through 180 degrees along fold line 25 which is located preferably about half way between floor end 29 and top end 27 of spine 28. Side panel 30 is folded through 180 degrees along score line 38 extending perpendicularly from floor end 31 to point of coincidence 35 of seat cushion end 34 and backrest end 36. Similarly, second side panel 40 is folded through 180 degrees along score line 48 extending perpendicularly from floor end 41 to point of coincidence 45 of seat cushion end 44 and backrest end 46. All other blanks are preferably similarly folded flat and stacked together to form a flat package which can be easily handled and transported.

Just as the dimensions of car seats vary, the dimensions of tire display assembly 10 may vary. Generally, however, the lengths of cushion ends 34 and 44 are calculated and measured to accommodate the various widths of the tires sought to be displayed, and the lengths of back rest ends 36 and 46 are calculated and measured to accommodate the various diameters of the tires sought to be displayed.

It should also be appreciated that the tire display assembly of the invention may be used as described or with appropriate modifications to support and display other objects in addition to or instead of tires.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

What is claimed is:

1. A tire display assembly resembling a car seat and comprising a plurality of foldable blanks which when assembled form:

(a) a back portion having a flat, upwardly and rearwardly sloping backrest suited for supporting an upper, rear casing surface of a tire;

(b) a seat portion having a front board and a flat, rearwardly and downwardly sloping cushion portion, said seat portion suited for supporting a bottom tread portion of a tire;

(c) two vertical side panels situated on each side of said backrest and said seat portion, said two side panels, said cushion portion and said front board forming an enclosed space beneath said cushion portion; and (d) a support structure positioned beneath said cushion portion in said enclosed space and hidden from view.

2. A tire display assembly simulating the appearance of a car seat comprising:

(a) a vertical support folding blank which, when folded, simulates the spine and the sides of a car seat, comprising:

(i) a substantially rectangular spine panel having a first vertical side, a second vertical side, and two horizontal sides;

(ii) a first side panel having a floor end, front end, knee end, cushion end, backrest end, top end and vertical end which together form a shape substantially resembling in profile that of a car seat, and foldably connected along the vertical end of said first side panel to the first vertical end of the spine panel; and (iii) a second side panel, identical in shape to the first side panel, having a floor end, front end, knee end, cushion end, backrest end, top end and vertical end which together form a shape substantially resembling in profile that of a car seat, and foldably connected along the vertical end of said second side panel to the second vertical end of the spine panel;

(b) a base folding blank which, when folded and assembly is completed, simulates the floor panel and the cushion of a car seat, defines a space, and is capable of supporting a vehicle tire, and which attaches to the vertical support blank by a first means of attachment, comprising:

(i) a floor panel in the shape of a trapezoid, having symmetrical sides, a base, and an edge opposite the base, and having said edge opposite the base the same width as the width of the spine of the vertical support;

(ii) a front panel in the shape of a trapezoid having symmetrical sides, a base, and an edge opposite and shorter than the base, and foldably connected along said edge opposite the trapezoid base to the base of the floor panel;

(iii) a knee panel in the shape of a trapezoid, having symmetrical sides, a base, and an edge opposite and shorter than the base, and foldably connected along said base to the trapezoid base of the front panel; and (iv) a cushion panel in the shape of a trapezoid, having symmetrical sides, a base, and an edge opposite and shorter than the base, and foldably connected along said base to the edge opposite the base of the knee panel;

(c) a front folding blank which, when folded, simulates the backrest and the top of a car seat and which attaches to the base folding blank by a second means of attachment and attaches to the vertical support blank by a third means of attachment, comprising:

(i) a backrest panel in the shape of a trapezoid, having symmetrical sides, a base, and an edge opposite and shorter than the base, and having said base the same width as the edge opposite the base of the cushion panel; and (ii) a top panel in the shape of a trapezoid, having symmetrical sides, a base, and an edge opposite and shorter than the base, and foldably connected along said base to the edge opposite the base of the backrest panel and having said edge opposite its base the same width as the edge opposite the base of the floor panel.

3. The tire display assembly according to claim 2 further comprising an advertising panel which is capable of displaying printed matter, comprising:

(a) a header capable of displaying printed matter and erectly positioned on top of the tire display assembly by fourth means of attachment, comprising:

(i) a substantially trapezoidal header board blank; and (ii) a substantially triangular easel folding blank having a fifth means of attachment to the header board.

4. The tire display assembly according to claim 3 wherein said fourth means of attachment comprises a flap extending from the header board and a slit cut into the top panel of the front blank.

5. The tire display assembly according to claim 2 wherein said first, second and third means of attachment include flap portions foldably connected to selected of said blanks and double sided adhesive tape fitted upon said flap portions.

6. The tire display assembly according to claim 2 further comprising a mass support sized to fit inside said space defined by the base folding blank, said mass support, when placed in said tire display assembly, being capable of supporting the mass of a vehicle tire, comprising:

(a) a first tapered mass support blank having a flat edge to be placed on top of the floor panel, a first erect edge, a second erect edge which is shorter in length than the first erect edge and is disposed at the opposite end of said flat edge, and an obliquely oriented edge opposite the flat edge;

(b) a second tapered mass support blank, identical in shape and size to the first tapered mass support blank, having a flat edge to be placed on top of the floor panel, a first erect edge, a second erect edge which is shorter in length than the first erect edge and disposed at the opposite end of said flat edge, and an obliquely oriented edge opposite the flat edge;

(c) a first rectangular mass support blank substantially rectangular in shape;

(d) a second rectangular mass support blank substantially rectangular in shape and smaller in size than the first rectangular mass support folding blank; and (e) means for cross attachment of the first and second tapered mass support blanks to the first and second rectangular mass support blanks.

7. The tire display assembly according to claim 6 wherein said means of cross attachment comprises slits cut in the mass support blanks.

8. The tire display assembly according to claim 2 further comprising an advertising panel capable of displaying printed matter, comprising:

(a) a header capable of displaying printed matter and erectly positioned on top of the tire display assembly by fourth means of attachment, comprising:

(i) a substantially trapezoidal header board blank; and (ii) a substantially triangular easel folding blank having a fifth means of attachment to the header board.

9. The tire display assembly according to claim 3 wherein said fifth means of attachment comprises a flap portion foldably connected to the easel and double-sided adhesive tape fitted upon said flap portion.

* * * * *